United States Patent [19]

Carter

[11] 4,288,299

[45] Sep. 8, 1981

[54] ENHANCED HYDROTHERMAL SEALING OF ANODIZED ALUMINUM

[75] Inventor: Bryan G. Carter, Banbury, England

[73] Assignee: Alcan Research and Development Limited, Montreal, Canada

[21] Appl. No.: 38,125

[22] Filed: May 11, 1979

[30] Foreign Application Priority Data

May 22, 1978 [GB] United Kingdom ..... 21032/78

[51] Int. Cl.[3] ..... C25D 11/18

[52] U.S. Cl. ..... 204/35 N; 148/6.27; 204/38 A; 427/419.2

[58] Field of Search ..... 204/35 N, 38 A; 148/6.27; 427/343, 419.2

[56] References Cited

U.S. PATENT DOCUMENTS

| | | | |
|---|---|---|---|
| 2,888,388 | 5/1959 | Stiller | 204/35 N |
| 3,174,916 | 3/1965 | Cohn | 204/35 N |
| 3,365,377 | 1/1968 | Michelson | 204/35 N |
| 3,382,160 | 5/1968 | Asada | 204/35 N |
| 3,795,590 | 3/1974 | Patrie | 204/35 N |
| 3,849,264 | 11/1974 | Weber et al. | 204/35 N |

FOREIGN PATENT DOCUMENTS

| | | | |
|---|---|---|---|
| 1521664 | 2/1971 | Fed. Rep. of Germany | 204/35 N |

OTHER PUBLICATIONS

Hackh's Chemical Dictionary, McGraw-Hill Book Co., 1969, (Fourth Edition), pp. 35, 80.

*Primary Examiner*—Delbert E. Gantz
*Assistant Examiner*—William Leader
*Attorney, Agent, or Firm*—Cooper, Dunham, Clark, Griffin & Moran

[57] ABSTRACT

Hydrothermal sealing of anodic oxide coatings is promoted and enhanced by pretreating the anodic oxide coating to be sealed in a mildly basic aqueous medium at temperatures up to those required for hydrothermal sealing of the coating.

14 Claims, No Drawings

ENHANCED HYDROTHERMAL SEALING OF ANODIZED ALUMINUM

BACKGROUND OF THE INVENTION

1. Field of the Invention

This invention relates generally to a process for the production of sealed anodized aluminum and, more particularly, to a process that enables enhanced hydrothermal sealing of the anodic oxide coating formed on aluminum substrates.

2. Description of the Prior Art

Anodic oxide coatings are established upon aluminum or aluminum alloy substrates for various purposes including those of improving resistance to corrosion and abrasion. These coatings are formed by various conventional methods. For example, the anodic coating may be formed by anodizing (passing electric current through the treating solution with the substrate being coated serving as the anode) in an acid medium such as a sulfuric acid solution or a sulfuric acid containing sulfophthalic acid solution according to well known procedures.

In most current commercial practice direct-current anodizing in a sulfuric acid-based electrolyte has substantially replaced most other anodizing processes for the production of thick, clear, porous-type anodic oxide coatings, because of its efficiency in consumption of electrical current as compared with earlier alternating current processes. In general, direct current anodizing voltages employed for sulfuric acid-based electrolytes range from 12 to 22 volts depending upon the strength and temperature of the acid. Sulfuric acid-based electrolytes include mixtures of sulfuric acid with other acids, such as oxalic acid and sulphamic acid, in which the anodizing characteristics are broadly determined by the sulfuric acid content. Typically in sulfuric acid anodizing the electrolyte contains 15–20% (by weight) sulfuric acid at a temperature of 20° C. and a voltage of 17–18 volts.

The coatings produced by the foregoing methods have no color. They are often referred to as clear anodized coatings. Such coatings can, however, be colored by various well known procedures including dying, hard color anodizing and electrolytic deposition.

Coloring by electrolytic deposition of inorganic particles has become particularly well known. In the electrolytic deposition process, inorganic material is deposited in the pores of the anodic oxide coating by the passage of electric current (usually alternating current) between the anodized aluminum substrate and a counterelectrode, while the anodized substrate is immersed in an acidic bath of an appropriate metal salt. The most commonly employed electrolytes are salts of nickel, cobalt, tin and copper. The counterelectrode is usually graphite or stainless steel, although nickel, tin and copper electrodes are also employed when the bath contains the salt of the corresponding metal.

The production of anodic oxide coatings, both clear and colored, can be performed with either batch or continuous operations. Batch operations are particularly adopted for anodizing small individual articles. In a batch operation the article to be coated is first anodized generally by immersing for a given period of time in an anodizing bath and then, if color is desired, the article is subsequently immersed in a coloring bath. Continuous operations are particularly adapted to anodizing strip or coiled aluminum substrates. In continuous operations the strip or coil is continually passed through the anodizing bath and, if desired, subsequently through a coloring bath. Known methods for batch anodizing are disclosed in U.S. Pat. Nos. 3,382,160; 3,616,297; 3,616,308; 3,616,309; and 3,622,471. Methods for practicing continuous anodizing are shown in U.S. Pat. Nos. 3,359,189; 3,359,190; 3,471,375; 3,535,222; and 3,718,547.

Anodic oxide coatings established on aluminum substrates are generally comprised of substantially anhydrous aluminum oxide. These coatings or films are relatively hard, porous and highly absorbent. For most purposes the substantially anhydrous coating as established on the metal substrates is found unsatisfactory. However, these characteristics can be markedly improved by a process hereinafter referred to as "sealing".

Sealing is basically a hydrothermal process wherein the formed, porous aluminum oxide coating combines with water at temperatures which enhance the formation of the hydrated oxide material. Sealing is believed to consist primarily of the conversion of substantially anhydrous aluminum oxide to various hydrated products with the attendant swelling or volume increase which is effective to partially close or "seal" the pores thereby diminishing the surface area of the coated surface. Sealing thus reduces the absorbency of the coated material rendering it more impervious. Poor sealing results in an inferior anodized product which tends to stain and "bleed" (if colored by certain processes).

In conventional sealing of anodized aluminium the alumina at the walls of the pores in the oxide film is partially hydrated by contact with hot water (usually 80° C.—boiling point) held at a pH of 5.5–6.5. This hydration swells the alumina and causes the pores to become essentially filled with partially hydrated alumina. Regardless of the composition of the anodic coating, the solids formed by the hydrothermal treatment are aluminium hydroxide gel, pseudoboehmite, and crystalline boehmite.

An often objectionable side effect of the sealing process is a noticeable and undesirable change in the surface appearance of the anodized coating which has been found to be caused by the formation of a residual layer of loose crystalline boehmite on the surface of the anodic film that often appears iridescent or velvety. This so-called "smut" (sometimes referred to as "smudge") is an especially severe problem with colored anodic coatings.

Various post-sealing treatments have been proposed for removing smut including wiping, and spraying or dipping in mineral acid. None of these procedures have, however, been found to be acceptable. Wiping is time consuming and labor intensive, and, consequently, not commercially desirable. Mineral acid treatments are undesirable in that in many instances smut removal has been found to be incomplete. Additionally, in some instances the acid detrimentally affects the degree and quality of the seal.

Unfortunately once smut is formed during sealing, it cannot be removed except by mechanical or chemical means. Consequently, various proprietary anti-smut additives have been developed and marketed to suppress the initial formation of smut during the sealing process. These additives are incorporated into the sealing bath and generally function by suppressing the formation of crystalline boehmite particles on the surface of the anodic oxide coating while still allowing hydration to take place in the pores of the coating, particularly at the mouth of the pores. The sealing quality attained using baths containing such additives has been found to be satisfactory. Such additives are ineffective, however, in removing smut once it has been formed.

Examples of anti-smut additives for incorporation in sealing baths for anodic oxide films are described in British Pat. Nos. 1,265,424; 1,302,288; 1,368,336; 1,398,589 and 1,419,597. Examples of commercially available anti-smut additives are Henkel VR/6252/1, Henkel VR/6253/1 and Sandoz Sealing Salts A/S.

While minor traces of boehmite particles can upon close inspection usually be detected on the surface of coatings produced from such additive-containing baths, such coatings are generally considered to be "smut-free".

In many anodizing plants the sealing stage has been found to be a bottleneck in the process, because of the relatively long period of time involved to effect a seal of good quality. In conventional hot water sealing the time required to effect such a seal is generally about 2 to 3 minutes per micron of film thickness. Consequently, the time required to seal a load of anodized work having an anodic oxide coating of 25 microns in thickness may be an hour or more. Moreover, the cost, due to energy consumption, of maintaining hot water baths at or near their boiling points for periods of time longer than necessary continues to become increasingly prohibitive.

Sealing accelerators have therefore been developed which when added directly to the sealing bath accelerate the sealing process. Thus it is known that the sealing process may be accelerated by the addition of accelerators directly to the hot water sealing bath. Such accelerators are usually mildly basic substances which raise the alkalinity of the sealing bath to a value in the range of pH 7 to 11. U.S. Pat. Nos. 3,365,377 and 3,822,156 disclose the addition of triethanolamine to hot water sealing baths to accelerate sealing.

Generally, raising the pH of the sealing bath has been found to accelerate the formation of boehmite. The formation of boehmite is accelerated in the pore mouths but unfortunately is also accelerated on the surface of the film also. While the addition of TEA to a sealing bath free of anti-smut additive reduces the sealing time to about 1 min/micron film thickness, it also gives rise to a level of smut formation which is unacceptably high. Thus as for example in U.S. Pat. No. 3,822,156, sealing in the presence of an accelerator requires a post sealing smut removal step. Attempts to remove the smut formed during sealing in the presence of an accelerator have not been entirely satisfactory. While in some instances reasonable amounts of smut have been removed in this manner, sometimes smut removal has been incomplete, and, on other occasions, employing the smut removal step has been detrimental to the degree and quality of the seal.

Anti-smut additives cannot generally be used in a sealing bath containing an accelerator. Thus various methods have been tried to gain the expedience of the accelerated seal without attendant smut build-up. For example, temperatures have been lowered in the sealing bath containing the accelerator. While this method seems to reduce the smut formation, the seal quality has proven poor resulting in staining due to open pores in the anodic oxide coating.

SUMMARY OF THE INVENTION

It has now been unexpectedly discovered that conventional hydrothermal sealing of anodic oxide coatings can be promoted and enhanced by pretreating the anodic oxide coating to be conventionally hydrothermally sealed with a mildly basic aqueous media under controlled conditions. Surprisingly, this preconditioning does not prohibit the use of an anti-smut additive in the subsequent hydrothermal sealing process. Such preconditioning when employed with a sealing process utilizing anti-smut additives can effect the formation of a very rapid smut-free seal.

Broadly stated the invention contemplates a pretreatment or preconditioning accomplished prior to conventional hydrothermal sealing wherein an anodic oxide coating established on an aluminum substrate is brought into intimate contact with a mildly basic aqueous medium under controlled conditions. The sealing is preferably accomplished in the presence of smut inhibitors. In accordance with one aspect of the invention, a pre-established anodic oxide coating on an aluminum substrate is preconditioned for subsequent rapid and effective hydrothermal sealing by immersing the anodic oxide coated substrate in a media comprised of a mildly basic aqueous solution at a temperature below that required for sealing and for a time which enhances and promotes subsequent hydrothermal sealing.

In accordance with a preferred embodiment anodized aluminum is rapidly, conventionally sealed in a manner which substantially eliminates the need to remove smut by pretreating the anodized aluminum to be sealed in a mildly alkaline aqueous media prior to hydrothermally sealing the anodized aluminum in the presence of a smut inhibitor. In accordance with a greatly preferred embodiment enhanced smut-free sealing of an anodic oxide coating is accomplished by contacting the anodic coating with an aqueous medium containing an effective amount of triethanolamine (TEA) at a temperature below that required for sealing.

DETAILED DESCRIPTION

Further features and advantages of the invention will be apparent from the detailed description of the invention. In accordance with a preferred embodiment of the invention, hydrothermal smut-free sealing of the anodic oxide coating is accomplished in two steps. First, the anodized aluminum, to be sealed, is pretreated by contact with a mildly basic aqueous bath prepared by addition of a basic material (Lewis base) to water in order to establish a solution having a pH in the range from about 7 to about 11 and preferably from about 8 to about 10. The temperature of the bath is regulated from about ambient to a temperature just below that required for sealing; and, preferably is regulated in the range from about 20° C. to about 80° C. The anodized aluminum is immersed in the bath for a period of time sufficient to promote and enhance rapid conventional sealing and preferably for about less than 1 minute per mil of coating thickness.

In the second step the anodized aluminum material thus pretreated is then immersed in a sealing bath, preferably containing an anti-smut additive, at standard temperatures for accomplishing conventional sealing. Preferably the temperature of the sealing bath ranges from about 80° C. to just below its boiling point and has a pH range from about 5 to about 7, more preferably from about 5.5 to about 5.6.

The process of the invention can be employed with both clear and previously colored anodized material as well as with batch and continuous anodizing operations. The anodized aluminum to be sealed according to the invention may be formed by any conventional method. For example, the anodic coating on the aluminum may be created by anodizing (passing electric current through the treating solution with the object being coated serving as anode) in a sulfuric acid solution or a sulfuric acid containing sulfophthalic acid solution, for example, according to well known procedures. In addition to the foregoing, there are a number of less commercial processes for producing oxide layers on aluminum.

The term aluminum as used herein means pure aluminum as well as aluminum base alloys containing at least 50% by weight aluminum. The aluminum substrate can have any desired shape or form, e.g., extruded, drawn, machined or rolled shapes and forms are all applicable to the present invention. The anodic oxide coating can be clear or colored.

The pretreating is carried out generally by intimate contact of the anodic coating to be sealed with a mildly basic aqueous medium for a time and at a temperature effective to promote and enhance the sealing of the anodic coating in a subsequent conventional, hydrothermal process.

It will be apparent that the pretreating parameters of immersion time, temperature and pH of the aqueous preconditioning medium are interrelated. The specific combination to be employed can be selected to accommodate the operating parameters of any particular anodizing operation. Within limits a shortened immersion time will require an elevation of temperature and/or pH. Contrawise a lower operating temperature will necessitate a higher pH and/or longer immersion time, etc. It will be realized that the preconditioning of the oxide coating is to facilitate subsequent sealing. Therefore, regulating immersion time, pH and temperature of the preconditioning medium is somewhat empirical. Generally, however, these operating conditions are regulated such that little or no smut is formed on the pretreated surface. The presence of substantial amounts of smut indicates some sealing is taking place and specifically lower temperatures and/or pH of the aqueous media is indicated.

Additionally for purposes of achieving efficient operation of the process of the invention, immersion time in the pretreating bath should not exceed the immersion time in the sealing bath, at least for batch operations. Otherwise, the pretreatment stage may become a bottleneck in the process. A practical upper limit of immersion time would therefore be about 30 minutes. Immersion times of less than about 1 minute generally will not be practical for batch operations due to time requirements for physically immersing and removing the workpiece. On the other hand, for continuous anodizing lines (where the immersion time is precisely controlled by strip speed) shorter immersion times (less than 1 minute and in some instances a few seconds) can be employed presuming the temperature and pH of the bath are adjusted to accommodate such conditions.

The basic substance that can be used in accordance with the invention to adjust the pH of the pretreatment medium are generally Lewis bases and, more preferably, inorganic materials which dissociate in aqueous media to yield and hydroxyl ion. A preferred group of such substances includes TEA as well as sodium borate, sodium carbonate, ethanolamine and hexamine. TEA has been found to be the preferred of these additives because of its solubility in water, stability, non-volatility and effectiveness at very low concentrations. It will be realized that substances which dissociated to yield ions which inhibit the hydration process should be avoided. Included in this latter group of ions are phosphate, silicate and fluoride ions.

The concentration of the basic material used to adjust the pH of the pretreating medium will vary with the particular material employed as well as with the selection of temperature and immersion time. The concentration should, however, be adjusted to such a level to give the pretreating medium a pH in the range of about 7 to about 11, preferably from about 8 to about 10. For TEA, concentrations in the range of about 0.5 to about 5 ml/l have been found to be sufficient. With sodium borate, a concentration in the range of about 2 g./l. has been found to work successfully. The same was found to be true with sodium carbonate at a concentration in the range of about 0.25 g./l.; ethanolamine at a concentration in the range of about 0.25 ml./l.; and hexamine at a concentration of about 20 g./l.

The temperature of the pretreating bath may range from ambient temperature, (about 20° C.), to temperatures just below those required for sealing. For batch anodizing operations temperatures up to about 80° C. have been found sufficient. Those temperatures in the range of from about 20° to 60° C. are preferable and those from about 40° C. to about 50° C. are most preferred. With the ever increasing costs of energy, however, it may prove to be most advantageous to operate the bath at or near the ambient temperature by adjusting the parameters of time and pH. With a continuous anodizing line, the temperatures in the above ranges can be used but will generally be dictated by the immersion time, which in turn is dependent on the strip speed, as well as by the specific conditioning agent employed, its concentration, and the pH of the solution.

The sealing operation is carried out by conventional means well known in the art such as intimate contact of immersing the pretreated anodized aluminum in a hot water sealing bath containing an anti-smut additive until an acceptable sealing quality is attained. The standards for assessment of sealing quality vary from country to country but generally relate to assessing the endurance potential to the protective effect of the anodic oxide coating when exposed to various weathering conditions. One such standard test is British Standard Specification No. 1615:1972 Appendix E which is an acidified sulfite test that measures the weight loss of the coating during the test. Another such test was disclosed by J. H. Manhart and W. C Cochran in a paper entiled "Acid Dissolution Tests for Seal Quality of Anodized Aluminum" that was presented at the 57th Annual Convention, American Electroplaters' Society, Montreal, Quebec, Canada, June 22, 1970.

The temperature of the sealing bath will generally range from about 80° C. to the boiling point. Temperatures less than about 80° C. have generally been found to be inadequate for attaining acceptable sealing levels. The pH of the sealing bath should be maintained in the range of about 5 to 7, and preferably 5.5 to 6.5. Levels of pH below about 5 have generally been found to be too acidic. Acid levels below this range are ineffective in sealing and may tend to attack the integrity of the coating. Levels of pH above about 7 tend to increase the level of boehmite formation and, consequently, increase the level of smut formation and, if an anti-smut additive is employed, counteract the beneficial effects of such additive.

The standards for using and the criteria for selecting anti-smut additives are well known in the art. However, three proprietary anti-smut addities have been found to be of particular value with the process of this invention. These additives are Henkel VR/6252/1, Henkel VR/6253/1, and Sandoz Sealing Salts A/S. Effective concentrations for these additives in sealing baths used with the process of the invention have been found to be: Henkel VR/6252/1 at 1 ml/l; Henkel VR/6253/1 at 2 ml/l; and Sandoz Sealing Salt A/S at 3 g/l. Other proprietary anti-smut additives, as well as varying concentrations of these and the above noted additives, may also be employed with the process of the invention provided they permit satisfactory sealing quality.

Immersion time in the sealing bath is dependent primarily on the degree of treatment of the anodized coating in the pretreating bath, the thickness of the coating, and the temperature and composition of the sealing bath. Without use of the pretreating bath sealing times of 2 to 3 minutes per micron of thickness of the anodized coating can be expected. However, with the use of the pretreating bath, under various conditions, sealing times of less than 1 minute per micron of thickness can be expected.

The process of the invention can be employed with both bath and continuous anodizing operations. In either case the operating parameters of each step of the process must be established within the foregoing limitations to accommodate the operating conditions of the particular anodizing operation with which it is to be used.

As an alternate to utilizing the pretreating step of the present invention solely for reducing the immersion time in the sealing bath, it has been found that it also can be used for the purpose of reducing the operating temperature of the sealing bath. Reducing the sealing bath temperature, within limitations, generally results in the necessity for longer immersion times to attain comparable sealing qualities. However, if the pretreating step of the present invention is employed, the sealing bath immersion time will be reduced, regardless of the operating conditions of the sealing bath. Consequently, utilization of the pretreating step of the present invention can permit a reduction in the sealing bath temperature, for example from 100° C. to 80° C., with the resultant savings in energy without increasing, and, under various conditions, with reducing the immersion time in the sealing bath. Various combinations of reduced sealing bath temperatures and/or immersion times are available depending on the needs of the particular anodizing operation when the pretreating operation of the present invention is employed.

By way of further illustration of the invention, reference may be made to the following specific examples:

In the following examples the acidified sulfite test described in British Standard Specification No. 1615: 1972 Appendix E was used to evaluate sealing quality. In these examples the sealing quality was rated in accordance with the weight loss obtained in this test on the following scale:

| Quality | Weight Loss (mg/dm$^2$) |
|---|---|
| A | 5 and below |
| B | 6–10 |

-continued

| Quality | Weight Loss (mg/dm$^2$) |
|---|---|
| C | 11–20 |
| D | 21–50 |
| E | over 50 |

Since contamination of the sealing bath with ionic material (which is almost inevitable in commercial operations) leads to decline in sealing quality, it is desirable but not mandatory to achieve at least Quality B (preferably A) in initial laboratory experiments before selecting operating conditions for a commercial sealing operation. In actual commercial operations, a Quality C seal is generally regarded as commercially acceptable.

Panels of aluminum alloy (AA6063) measuring 75 mm×50 mm were used throughout Examples I to V described hereafter. These panels were subjected to a conventional D.C. anodizing treatment in sulfuric acid to grow an anodic oxide film to a nominal 25 microns thickness. The panels were then electrolytically colored to a dark bronze finish and rinsed in water for 3 minutes before being treated by the process of the invention.

The panels were then subjected to a sealing procedure in accordance with the invention by immersion in a preconditioning media, followed by sealing in hot water containing proprietary anti-smut additives. Control experiments were in some instances performed at the same time, involving the immersion of panels in deionized water and sealing in hot deionized water (no additives in either bath).

After the sealing operation the panels were assessed visually for amount of sealing smut present. Those assessed as "Trace" or "Very Light" were considered to be of acceptable commercial quality and required no smut-removal post sealing treatment. The sealing quality was assessed by the above-mentioned acidified sulphite test described in British Standard Specification 1615.

In Examples I to V, TEA was used as the basic substance to adjust the pH of the pretreating bath. Changes of the following parameters of the pretreating bath were tested through the indicated ranges: TEA concentration in the pretreating bath was tested in the range of 0 to 5 ml./l.; pretreating bath temperature was tested in the range of 20° C. to 80° C.; and immersion time in the pretreating bath was tested in the range of 0 to 15 minutes.

In the sealing bath, sealing was continued for 5 to 30 minute intervals in the following solutions: deionized water, additive-free, at a pH of 6.0; Sandoz Sealing Salt A/S at a concentration of 3 g/l and a pH of 5.9; Henkel VR/6252/1 at a concentration of 1 ml/l and a a pH of 5.9; and Henkel VR/6253/1 at a concentration of 2 ml/l and a pH of 6.1.

EXAMPLE I

This example shows the effect of TEA concentration in the pretreating bath on smut level and sealing quality at varying sealing bath immersion times. In this example the pretreating bath temperature was maintained at 45° C. (except for the control and for the tests run at the 5 ml./l. concentration level wherein the temperature was 50° C.) and an immersion time of 5 minutes was used.

The sealing bath was operated at a temperature in the range of 95° to 100° C. The anti-smut additive that was used was Henkel VR/6253/1. A concentration of 2 ml/l of this additive was employed (except in the control test wherein no additive was used). The pH was 6.1 (except in the control test using only deionized water wherein the pH was 6.0). Immersion times in the sealing bath ranged from 5 to 30 minutes.

| Pretreating Bath Concentration of TEA (ml/l) | Sealing Bath Immersion Time (min.) | Sealing Smut Level | Sealing Quality |
|---|---|---|---|
| | 5(2) | Heavy | E |
| | 10(2) | " | E |
| 0(1) | 15(2) | " | D |
| | 30(2) | " | B |
| | 5 | Trace | E |
| | 10 | " | D |
| 0.5 | 15 | " | C |
| | 30 | " | B |
| | 5 | Trace | D |
| | 10 | " | D |
| 1 | 15 | " | C |
| | 30 | " | B |
| | 5 | Trace | D |
| | 10 | " | C |
| 2 | 15 | " | C |
| | 30 | " | A |
| | 5 | Trace | D |
| | 10 | " | C |
| 5(3) | 15 | " | A |
| | 30 | Very Light | A |

(1)Deionized water, 5 min, 50° C.
(2)Deionized water 100° C. - no anti-smut additive
(3)50° C.

In general, this example suggests that the time required to attain a given sealing quality in the presence of the specific anti-smut additive progressively decreases as the TEA concentration in the pretreating bath increases. Even the lowest TEA concentration tested showed acceleration of the sealing process. The example indicates that under the conditions tested the sealing time can be reduced to less than 15 minutes, if a TEA concentration of 5 ml/l is employed, and still yield a product having acceptable levels of smut and sealing quality.

EXAMPLE II

This example shows the effect of temperature in the pretreating bath on smut levels and sealing quality at varying sealing bath immersion times. In this example TEA was used as the basic material for adjusting the pH of the pretreating bath. The TEA concentration in the pretreating bath was maintained at 1 ml/l and a 5 minute immersion time in the bath was used throughout the test.

The conditions used in the sealing bath were the same as in Example I with the exception that no control group (no anti-smut additive present) was used.

| Pretreating Bath Temperature (0° C.) | Sealing Bath Immersion Time (min.) | Sealing Smut Level | Sealing Quality |
|---|---|---|---|
| | 5 | Trace | E |
| | 10 | " | C |
| 20 | 15 | " | B |
| | 30 | Very Light | A |
| | 5 | Trace | D |
| | 10 | " | C |
| 52 | 15 | " | B |
| | 30 | Very Light | A |
| | 5 | Medium | C |
| | 10 | " | B |
| 68 | 15 | " | A |
| | 30 | " | A |
| | 5 | Heavy | B |

-continued

| Pretreating Bath Temperature (0° C.) | Sealing Bath Immersion Time (min.) | Sealing Smut Level | Sealing Quality |
|---|---|---|---|
| | 10 | " | A |
| 80 | 15 | " | A |
| | 30 | " | A |

This example indicates that acceptable levels of sealing quality and smut level can be attained with the pretreating bath being operated at ambient temperatures, i.e., 20° C. It also suggests that when TEA is used as the basic substance the bath is most effective when the temperature does not exceed about 60° C. for operating conditions roughly equivalent to those employed in this example.

EXAMPLE III

This example shows the effect of immersion time in the pretreating bath on smut level and sealing quality at varying sealing bath immersion times. TEA was used as the basic substance at a concentration of 1 ml/l of water. The bath temperature was maintained at 50° C. and the immersion time in the pretreatment bath was varied from 0 to 15 minutes. The sealing bath conditions were the same as in Example I with the exception that no control group (no anti-smut additive present) was used.

| Pretreating Bath Immersion Time (min.) | Sealing Bath Immersion Time (min.) | Sealing Smut Level | Sealing Quality |
|---|---|---|---|
| | 5 | Trace | E |
| | 10 | " | D |
| 0 | 15 | " | B |
| | 30 | " | A |
| | 5 | Trace | E |
| | 10 | " | C |
| 1 | 15 | " | A |
| | 30 | " | A |
| | 5 | Trace | D |
| | 10 | " | B |
| 5 | 15 | " | A |
| | 30 | " | A |
| | 5 | Light | C |
| | 10 | " | A |
| 15 | 14 | " | A |
| | 30 | " | A |

In general this example indicates that acceptable levels of sealing quality and smut level can be attained with reduced sealing bath utilization if the pretreating operation is employed. This example suggests that there is considerable tolerance in the selection of pretreating bath immersion times to attain a given sealing quality and smut level.

EXAMPLE IV

This example shows the effect of various anti-smut additives on sealing quality and smut level with the process of the invention at varying sealing bath immersion times. In this example TEA was employed (except in the control test wherein no additive was used). The TEA concentration was maintained at 1 ml/l. The bath temperature was 50° C. and the immersion time was 5 minutes.

The sealing bath was operated at a temperature of 95° to 100° C. Two of the sealing bath series of tests were run with only deionized water, i.e. no anti-smut additive. The pH of these baths was 6.0. One series of tests was run for each of the following anti-smut additives at the indicated concentration and pH levels: Henkel VR/6252/1 at a concentration of 1 ml/l and a pH of 5.9; Henkel VR/6253/1 at a concentration of 2 and ml/l and a pH of 6.1; and Sandoz Sealing Salt A/S at a concentration of 3 g/l and a pH of 5.9.

| Pretreating Bath | Sealing Bath | Seal Time (min) | Sealing Smut Level | Sealing Quality |
|---|---|---|---|---|
| | | 5 | Heavy | E |
| Deionized Water | Deionized Water | 10 | " | E |
| | | 15 | " | D |
| | | 30 | " | B |
| | | 5 | Heavy | D |
| TEA | Deionized Water | 10 | " | C |
| | | 15 | " | C |
| | | 30 | " | A |
| | | 5 | Trace | D |
| TEA | Henkel VR/6252/1 | 10 | " | B |
| | | 15 | " | A |
| | | 30 | " | A |
| | | 5 | Trace | D |
| TEA | Henkel VR/6253/1 | 10 | " | B |
| | | 15 | " | A |
| | | 30 | " | A |
| | Sandoz | 5 | | D |
| TEA | Sealing Salt A/S | 10 | Light Patchy | C |
| | | 15 | | B |
| | | 30 | Smut | A |

This example indicates that various commercially available anti-smut additives can be utilized with the process of the invention. Further, in every instance the use of a pretreating bath in accordance with the invention resulted in accelerated sealing times.

EXAMPLE V

This example shows the effect of immersion time in the pretreating bath containing TEA at the relatively low concentration of 1.5 ml/l and a bath temperature of 20° C.

The sealing bath was operated under the same conditions as in Example I with the exception that no control group (no anti-smut additive present) was used.

| Pretreating Bath Immersion Time (min.) | Sealing Bath Immersion Time (min.) | Sealing Smut Level | Sealing Quality |
|---|---|---|---|
| 0 | 10 | Trace | D |
| | 15 | " | C |
| | 20 | " | B |
| | 10 | " | D |
| 5 | 15 | " | C |
| | 20 | " | B |
| | 10 | " | D |
| 10 | 15 | " | B |
| | 20 | " | A |
| | 10 | " | C |
| 15 | 15 | " | B |
| | 20 | " | A |

This example indicates that given sealing qualities and smut levels can be attained with sealing bath immersion times of 15 to 20 minutes utilizing pretreating baths with relatively low TEA concentrations, ambient temperature and immersion times that are less than the immersion time in the sealing bath.

EXAMPLE VI

This example shows the use of various basic substances in accordance with the invention. In the tests disclosed in this example the material treated was anodized aluminum having an anodic oxide coating that had been subjected to an electrolytic coloring treatment. The thickness of the coating was 25 microns.

The pretreating bath was operated at 55° C. to 65° C. and the immersion time was 5 minutes. The basic substances employed along with concentrations and pH levels for each are indicated in the table below. The process was operated under the same conditions as in Example I with the exception that no control test (no anti-smut additive present) was used.

| Pretreating Bath Operating Conditions | | | Sealing Quality Immersion Time in Sealing Bath (min.) | | | | Sealing Smut Level (After 15 to 30 Minutes Sealing) |
|---|---|---|---|---|---|---|---|
| Basic Substance | Concentration in Bath | pH of Bath | 5' | 10' | 15' | 30' | (Time) |
| Sodium Borate ($Na_2B_4O_710H_2O$) | 2.0 g/l | 9.2 | D | C | B | B | Light |
| Sodium Carbonate ($Na_2CO_3$) | 0.25 g/l | 10.6 | C | C | B | B | Light |
| Ethanolamine ($CH_2(OH)CH_2(NH_2)$) | 0.25 ml/l | 10.2 | D | C | B | B | Very Light |
| Hexamine ($(CH_2)_6N_4$) | 20.0 g/l | 7.8 | D | C | C | B | Very Light |
| Ammonium Acetate ($CH_3COOHN_4$) | 1.0 g/l | 6.2 | E | D | C | C | Trace |
| Deionized Water | — | 5.5 | E | D | C | C | Trace |

This example indicates that acceptable sealing quality and smut levels can be attained using the following additives in the process of the invention: sodium borate; sodium carbonate; ethanolamine; and hexamine. At the concentration and pH level tested ammonium acetate was not found to be effective.

EXAMPLE VII

In the foregoing examples the tests were performed under laboratory conditions with pretreating baths and sealing baths prepared with deionized water. It is impossible in commercial operations to prevent the carry over of ions from earlier treatment stages into the sealing bath and the sealing time required to achieve acceptable sealing quality in such operations in generally considerably greater than under laboratory conditions.

The tests disclosed in this example were carried out on a commercial anodizing line. In the first test no pretreating step was employed. In the second test the anodized aluminum was immersed in a pretreating bath utilizing TEA as the basic substance. The TEA concentration was 1.5 ml/l. The pretreating bath temperature was 45° C. and immersion time in the bath was 5 minutes.

In both tests an anti-smut additive was used in the sealing bath. The additive employed was Henkel VR/6253/1. Its concentration was 2 ml/l. Sealing quality was evaluated using British Standard Specification No. 1615:1972 Appendix E.

The following results were obtained:

| Test | Pretreating Bath | Sealing Time (min.) | Acidified Sulfite Test-Sealing Loss ($mg/dm^2$) |
|---|---|---|---|
| 1 | No | 60 | 17 |
| 2 | Yes | 20 | 16 |

The acidified sulfite test results indicate a sealing quality of C for each test which, as indicated earlier, is acceptable for commercial operations. Both tests yielded products with commercially acceptable smut levels.

This example demonstrates the beneficial effect of utilizing the pretreating procedure of the instant invention under commercial conditions. Immersion time in the sealing bath was reduced by 40 minutes (two-thirds) by utilization of the 5 minute pretreating step. This example clearly suggests that the pretreating procedure of the instant invention has a greater relative effect in commercial operations than in laboratory tests utilizing substantially uncontaminated sealing baths.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. In a method for producing hydrothermally sealed anodized aluminum including initially establishing an anodic oxide coating on a substrate of aluminum or aluminum base alloy; and, subsequently hydrothermally sealing the coating by subjecting the established anodic oxide coating on the substrate to hydrothermal sealing conditions in the presence of an amount of smut-inhibiting agent effective in inhibiting formation of smut incident to hydrothermal sealing, said smut-inhibiting agent being an agent for suppressing formation of crystalline boehmite particles on the surface of the anodic coating while permitting hydration to take place in the pores of the coating, the improvement which comprises:

promoting the hydrothermal sealing of the anodized aluminum by pretreating the established anodic oxide coating prior to hydrothermal sealing, with a basic aqueous medium at a pH in the range of about 7 to about 11 and a temperature of from about 20° C. to about 80° C. for up to about 30 minutes, the combination of said conditions being effective to enhance and promote sealing of said anodic oxide coating during the subsequent hydrothermal sealing step, but below those required to effect substantial sealing of the coating.

2. The method of claim 1 wherein said basic aqueous medium is rendered basic by addition of material selected from the group consisting of triethanolomine, ethanolomine, hexamine, sodium borate and sodium carbonate.

3. The method of claim 2 wherein said material is triethanolamine and the pH of said aqueous medium is in the range of from about 8 to about 10.

4. The method of claim 1, wherein said temperature is in the range of from about 40° C. to about 50° C.

5. The method of claim 1, wherein the anodic oxide coating is brought into intimate contact with said aqueous medium for a time of from about 1 to about 15 minutes.

6. A process for producing a sealed anodic oxide coating on an aluminum substrate comprising:

establishing an anodic oxide coating on said substrate;

pretreating the anodic oxide coating by subjecting said anodic oxide coating to a mildly basic aqueous medium at a pH in the range of about 7 to about 11 and a temperature of from about 20° C. to about 80° C. for up to about 30 minutes, the combination of said conditions being effective to enhance and promote sealing of said anodic oxide coating when the coating is subjected to a subsequent hydrothermal sealing step, but below those required to effect substantial sealing; and hydrothermally sealing said pretreated coating in the presence of sufficient anti-smut additive to produce a substantially smut-free surface, said anti-smut additive being an additive for suppressing formation of crystalline boehmite particles on the surface of the anodic coating while permitting hydration to take place in the pores of the coating.

7. The process of claim 6 including the step of electrocoloring said established anodic oxide coating prior to pretreating said coating.

8. The process of claim 7 wherein said electrocoloring step comprises immersing the anodized aluminum substrate in an acidic bath of a metal salt and depositing in the pores of the anodic oxide coating inorganic particles by the passage of electric current between said anodic oxide coating and a counterelectrode.

9. The process of claim 8 wherein the electric current used in the electrocoloring step comprises alternating current and the metal salts employed in said process are selected from a group consisting of nickel, cobalt, tin and copper.

10. A process for enhanced, hydrothermal sealing of anodic oxide coatings established on an aluminum substrate, comprising the steps of:

contacting said coating with a basic aqueous media having a pH of from about 7 to about 11, at temperatures from about ambient to about 80° C. and times up to about 30 minutes to pretreat said coating, the combination of said conditions being effective to enhance and promote sealing of said anodic oxide coating when the coating is subjected to a subsequent hydrothermal sealing step, but below those required to effect substantial sealing of the coating; and hydrothermally sealing said coating in an aqueous sealing bath containing an anti-smut additive in an amount effective to eliminate substantial formation of smut during sealing, said anti-smut additive being an additive for suppressing formation of crystalline boehmite particles on the surface of the anodic coating while permitting hydration to take place in the pores of the coating.

11. The process of claim 10 wherein said media is a solution of water and a substance selected from the group consisting of triethanolamine, ethanolamine, hexamine, sodium borate and sodium carbonate.

12. The process of claim 11 wherein said substance is triethanolamine, and the pH of said solution is from about 8 to about 10.

13. The process of claim 12 wherein said coating is contacted with said media for a time of from about 1 to about 15 minutes.

14. The process of claim 10 wherein said contacting is accomplished at a temperature in the range from about 40° C. to about 50° C.

* * * * *

UNITED STATES PATENT AND TRADEMARK OFFICE

CERTIFICATE OF CORRECTION

PATENT NO. : 4,288,299

DATED : September 8, 1981

INVENTOR(S) : Bryan G. Carter

It is certified that error appears in the above-identified patent and that said Letters Patent are hereby corrected as shown below:

Col. 4, line 68, "5.6" should read --6.5-- .

Col. 5, line 67, after "yield", "and" should read --an-- .

Col. 6, line 5, "dissociated" should read --dissociate-- .

Col. 7, line 6, "addities" should read --additives-- ;

line 29, after "both", "bath" should read --batch-- .

Col. 12, line 67, "in generally" should read --is generally-- .

Signed and Sealed this

Ninth Day of November 1982

[SEAL]

Attest:

GERALD J. MOSSINGHOFF

Attesting Officer

Commissioner of Patents and Trademarks